US008474959B2

(12) United States Patent
Nozawa et al.

(10) Patent No.: US 8,474,959 B2
(45) Date of Patent: Jul. 2, 2013

(54) LIQUID CONTAINER AND LIQUID EJECTING APPARATUS

(75) Inventors: Izumi Nozawa, Matsumoto (JP); Tadahiro Mizutani, Shiojiri (JP); Hiroyuki Nakamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 12/986,131

(22) Filed: Jan. 6, 2011

(65) Prior Publication Data

US 2011/0169899 A1 Jul. 14, 2011

(30) Foreign Application Priority Data

Jan. 8, 2010 (JP) ..... 2010-002940

(51) Int. Cl.
*B41J 2/175* (2006.01)

(52) U.S. Cl.
USPC ..... 347/86; 347/85; 347/87; 396/446; 422/400

(58) Field of Classification Search
None
See application file for complete search history.

(56) References Cited

U.S. PATENT DOCUMENTS

| | | | | |
|---|---|---|---|---|
| 5,923,353 | A * | 7/1999 | Boyd et al. | 347/85 |
| 6,084,617 | A * | 7/2000 | Balazer | 347/86 |
| 6,203,146 | B1 | 3/2001 | Pawlowksi, Jr. et al. | |
| 6,213,598 | B1 | 4/2001 | Hou et al. | |
| 6,250,747 | B1 | 6/2001 | Hauck | |
| 6,533,403 | B2 | 3/2003 | Hou et al. | |
| 6,685,307 | B2 * | 2/2004 | Dowell et al. | 347/85 |
| 6,976,753 | B2 | 12/2005 | Kuwabara et al. | |
| 7,156,507 | B2 * | 1/2007 | Aruga et al. | 347/85 |
| 7,784,927 | B2 * | 8/2010 | Inoue et al. | 347/86 |
| 8,167,416 | B2 | 5/2012 | Ohashi et al. | |
| 2002/0109760 | A1 * | 8/2002 | Miyazawa et al. | 347/86 |
| 2003/0020794 | A1 | 1/2003 | Chou et al. | |
| 2005/0068391 | A1 | 3/2005 | Inoue et al. | |
| 2010/0277555 | A1 * | 11/2010 | Katoh et al. | 347/86 |

FOREIGN PATENT DOCUMENTS

| | | | |
|---|---|---|---|
| CN | 1506225 | A | 6/2004 |
| CN | 101497273 | A | 8/2009 |
| EP | 1 380 429 | A2 | 1/2004 |
| EP | 1 570 996 | A1 | 9/2005 |
| EP | 1 604 824 | A1 | 12/2005 |
| JP | 2003-251826 | A | 9/2003 |
| WO | WO 2007/098524 | A1 | 9/2007 |

* cited by examiner

*Primary Examiner* — Matthew Luu
*Assistant Examiner* — John P Zimmermann
(74) *Attorney, Agent, or Firm* — Kilpatrick Townsend & Stockton LLP

(57) ABSTRACT

Provided is a liquid container containing a liquid which is to be supplied to a liquid ejecting apparatus, including: a containing portion containing the liquid and including a liquid out-flowing hole for out-flowing the liquid to an external portion and an air introducing hole for introducing external air into the containing portion, and a deforming portion being deformed in such a direction that a volume of the containing portion is reduced according to a decrease in an internal pressure of the containing portion; wherein the air introducing portion includes: a first sealing portion disposed in a circumference of the air introducing hole inside the containing portion; a second sealing portion displaceably disposed inside the containing portion and capable of closing the air introducing hole by pressing the first sealing portion outwards; and a biasing portion pressing the second sealing portion toward the first sealing portion.

7 Claims, 4 Drawing Sheets

100
101
102
110
111
112
113
114
115
116
120
120a
130a
130b
132
140
145
150
151
152
153
154
160
1101
1102
20
A0
A1
U
IB
IC
II
PB
PH
PL
PM

LIQUID CONTAINER AND LIQUID EJECTING APPARATUS

This application claims priority to Japanese Patent Application No. 2010-002940, filed Jan. 8, 2010, the entirety of which is incorporated by reference herein.

BACKGROUND

1. Technical Field

The present invention relates to a liquid container containing a liquid which is to be supplied to a liquid ejecting apparatus.

2. Related Art

In the related art, as a type of a liquid container containing a liquid which is to be supplied to a liquid ejecting apparatus, there are an open type, an air tight type, and a semi-air tight type.

In the open type liquid container, air is introduced into a space (hereinafter, referred to as a "liquid containing space"), where liquid is contained, according to consumption of the liquid. For this reason, in the open type liquid container, a valve is provided to a liquid introducing hole so that the liquid in the liquid containing space is not leaked from the air introducing hole to an external portion of the liquid container. In addition, there is also a type where an air chamber is separately provided between the air introducing hole communicating with an external portion of the liquid container and the liquid containing space, so that the leakage of the liquid is prevented. In addition, in the liquid container, when a liquid ejecting apparatus does not consume the liquid, the liquid in the liquid container is maintained in a negative pressure state so that the liquid is not leaked from the liquid container to the liquid ejecting apparatus side. For this reason, in the case of using the open type liquid container, a negative pressure generating unit for maintaining the liquid in the negative pressure state is installed at the outlet side of the liquid container or the liquid ejecting apparatus side. Therefore, in the aspect using the open type liquid container, there is a problem in that it is difficult to miniaturize the apparatus due to the air chamber, the negative pressure generating unit, or the like.

On the other hand, in the air tight type liquid container, at least a portion of the liquid containing space is constructed with a flexible member, for example, a sheet. In the air tight type liquid container, no air is introduced into the liquid containing space, and the sheet is deformed according to the consumption of the liquid, so that the liquid containing space is reduced. In addition, the inner portion of the liquid containing space is maintained in the negative pressure state by a spring which pushes up the flexible sheet against the contraction of the flexible sheet. As a result, when the liquid ejecting apparatus does not consume the liquid, the liquid is not leaked from the liquid container to the liquid ejecting apparatus side. Unlike the open type liquid container, in the air tight type liquid container, since the air chamber or the negative pressure generating unit are not necessary, it is easy to miniaturize the apparatus. However, since the generation of negative pressure is dependent on the flexible sheet and the spring, the negative pressure is increased according to the consumption of the liquid. Accordingly, there is a problem in that a constant negative pressure is not implemented in a time interval from the time of starting the use of the liquid container to the time of ending the use thereof. In addition, as a result, there is also a problem in that the liquid which is not completely used remains in the liquid container.

As a type having both features of the open type liquid container and the air tight type liquid container, there is a semi-air tight type liquid container (for example, JP-A-2003-251826). Even in the semi-air tight type liquid container, at least a portion of the liquid containing space is constructed with a flexible member, for example, a sheet. According to the consumption of the liquid, the sheet is deformed, so that the liquid containing space is reduced. The semi-air tight type liquid container is also similar to the air tight type liquid container in that the negative pressure is generated in the liquid containing space by a spring biasing the flexible sheet.

However, in the semi-air tight type liquid container, an air introducing hole for introducing air into the liquid containing space is installed. In addition, at the time when the liquid containing space is somewhat reduced by the deformation of the sheet, the valve of the air introducing hole is opened, so that the air is introduced into the liquid containing space. As a result, the liquid containing space is slightly increased by the amount of the introduced air. At the same time, the negative pressure of the liquid containing space is slightly decreased (to be close to the atmospheric pressure). After that, in the semi-air tight type liquid container, the negative pressure is increased by the spring which pushes up the flexible sheet according to the consumption of the liquid, and every time when the air introducing hole is opened, the negative pressure is slightly decreased (to be close to the atmospheric pressure). This movement is repeated. As a result, except for the time just after starting the use of the liquid container, a negative pressure which is stabilized within a predetermined range in the time interval reaching the time of ending the use of the liquid container may be implemented. As a result, in comparison with the air tight type, the amount of the liquid which is not completely used but remains in the liquid container is also decreased.

However, in the aforementioned related art, a valve structure 590 of an opening portion 592 (air introducing hole) presses the opening portion 592 in the direction from an outer side of an container exterior 563 (liquid container) toward an inner side, so that the opening portion 592 is sealed. For this reason, in the case where the internal pressure of the container exterior 563 (liquid container) is increased due to the increase of the temperature of external air or the like, there is a problem in that the valve structure 590 is pushed toward the outer side of the liquid container and thus, the opening portion 592 is opened, so that the liquid of the inner portion is leaked.

SUMMARY

An advantage of some aspects of the invention is to prevent an internal liquid from leaking even in the case where an internal pressure of a liquid container is increased in the liquid container which contains the liquid which is to be supplied to a liquid ejecting apparatus.

The invention may be implemented as the following aspects or application examples.

Application Example 1

There is provided a liquid container containing a liquid which is to be supplied to a liquid ejecting apparatus, including: a containing portion containing the liquid and including a liquid out-flowing hole for out-flowing the liquid to an external portion and an air introducing hole for introducing external air into the containing portion, and a deforming portion being deformed in such a direction that a volume of the containing portion is reduced according to a decrease in an internal pressure of the containing portion; and an air introducing portion opening and closing the air introducing hole, wherein the air introducing portion includes: a first sealing portion disposed in a circumference of the air introducing hole inside the containing portion; a second sealing portion displaceably disposed inside the containing portion and capable of closing the air introducing hole by pressing the first sealing portion outwards; and a biasing portion pressing the second sealing portion toward the first sealing portion, and wherein the deformation of the deforming portion is transmitted, so that the second sealing portion is separated from the first sealing portion.

In such an aspect, when the air introducing hole is to be closed, the second sealing portion presses the first sealing portion outwards, so that the air introducing hole is closed. For this reason, in the case where an internal pressure of the liquid container is increased in the state when the air introducing hole is closed, the second sealing portion more strongly presses the first sealing portion outwards. Therefore, in such a case, the internal liquid is not easily leaked.

Application Example 2

As the liquid container of Application Example 1, the deforming portion includes: a rigid portion which is not deformed according to a decrease in an internal pressure of the containing portion; and a flexible portion which is deformed according to the decrease in an internal pressure of the containing portion to displace the rigid portion in such a direction that a volume of the containing portion is decreased, wherein the second sealing portion is disposed at such a position that the second sealing portion is not overlapped with the rigid portion when the rigid portion is projected in the displacement direction, and wherein the air introducing portion further functions as a transmitting portion, and the liquid container further includes the transmitting portion which is installed to rotate about a supporting point and which is able to contact with the displaced rigid portion by the one side thereof with respect to the supporting point and is able to transmit the displacement to the second sealing portion by the other side thereof with respect to the supporting point.

In the aspect where the transmitting portion is disposed between the rigid portion and the second sealing portion and the displacement of the rigid portion is transmitted to the second sealing portion in the displacement direction, a length of a section (hereinafter, referred to as a "free running section") where the displacement of the rigid portion is not transmitted to the second sealing portion is not greatly limited to the structure or size of the containing portion or the air introducing portion. However, in such an aspect, in comparison with the aspect where the displacement of the rigid portion is transmitted to the second sealing portion in the displacement direction, it is possible to provide the free running section without a limitation by changing the layout of the supporting point in the transmitting portion, the distance from the supporting point to the portion contacting with the rigid portion, and the distance from the supporting point to the portion transmitting the displacement to the second sealing portion. In other words, it is possible to freely provide the free running section by appropriately determining the structure of the transmitting portion.

In addition, the following aspect is also preferable. The liquid container further includes a second biasing portion which is installed inside the containing portion to bias the rigid portion in the direction so that the volume of the containing portion is increased.

According to the aspect, it may be possible to generate a negative pressure in the containing portion. In addition, there may be used an aspect where the flexible portion has elasticity, and the negative pressure is generated in the containing portion by the elastic force against the deformation, that is, the elastic force for increasing the volume of the containing portion.

Application Example 3

As the liquid container of Application Example 2, in the transmitting portion, a distance from the supporting point to a portion contacting with the displaced rigid portion is longer than a distance from the supporting point to a portion transmitting the displacement to the second sealing portion.

According to the aspect, in comparison with the aspect where the distance from the supporting point to the portion contacting with the rigid portion is smaller than the distance from the supporting point to the portion transmitting the displacement to the second sealing portion, in the transmitting portion, the force caused by the displacement of the rigid portion is changed into a stronger force and the stronger force is transmitted to the second sealing portion. For this reason, even in the case where the second sealing portion is pressed toward the first sealing portion by the strong force of the biasing portion, the second sealing portion may be separated from the first sealing portion against the biasing force due to the displacement of the rigid portion. In other words, according to such an aspect, it is possible to set the biasing force of the biasing portion to be stronger. As a result, in a normal state, it is possible to more securely seal the air introducing hole.

Application Example 4

As the liquid container of Application Example 2 or 3, in a posture of the liquid container when the liquid container is used, the rigid portion is displaced in a horizontal direction, and the air introducing hole is located at a position higher than at least a portion of the rigid portion.

In an aspect where the transmitting portion transmits the displacement of the rigid portion to the second sealing portion in the displacement direction between the rigid portion and the second sealing portion, when the rigid portion is projected in the displacement direction, the second sealing portion may have to be disposed at the position (height) overlapped with the rigid portion. Therefore, it is difficult to dispose the air introducing hole at the position higher than the rigid portion. However, in the aforementioned aspect, the air introducing hole is located at the position which is not overlapped with the rigid portion and which is located above at least a portion of the rigid portion. For this reason, during the time when the liquid container is used, the air introducing hole is located above the surface level of the liquid earlier. Therefore, it is possible to decrease the probability that the liquid is leaked from the air introducing hole when the air is introduced from the air introducing hole.

Application Example 5

As the liquid container of Application Example 1, the air introducing hole is located at a position above a half position of the containing portion in a posture of the liquid container when the liquid container is used.

According to the aspect, in comparison with the aspect where the air introducing hole is located at a position below the half position of the containing portion, the surface level of the liquid in the containing portion is moved down below the air introducing hole at an earlier time. In addition, even when the air introducing hole is located below the surface level of the liquid, the pressure of the liquid in the vicinity of the air introducing hole is smaller. For this reason, during the time when the liquid container is used, there is a low probability that the liquid is leaked from the air introducing hole when the air is introduced from the air introducing hole.

Application Example 6

As the liquid container of Application Example 2, the rigid portion is a plate-shaped member having an outer shape protruding convexly outwards without a concave portion, and the flexible portion includes a curved portion which is connected to the rigid portion or supports the rigid portion in an outer circumference of the rigid portion and of which at least one of the folding or the extending from the folded state is implemented according to the change in the internal pressure of the containing portion.

According to the aspect, in the portion of the side of the rigid portion which is connected or supported, the curved portion has no three dimensional shape having ridges and valleys in the radial manner. Therefore, when the curved portion is folded or extended from the folded state according to the change in the internal pressure of the containing portion, it is difficult to restrain the deformation or to release the curved portion from the restrained state and rapidly deform the curved portion. Therefore, in the aspect, it is possible to reduce a probability that the internal pressure of the containing portion is rapidly changed.

In addition, in an aspect, the "curved portion being connected to the rigid portion or supporting the rigid portion" may be directly connected to the rigid portion or may directly support the rigid portion. In addition, in another aspect, the curved portion may be connected to the rigid portion through another member or may support the rigid portion through another member.

Application Example 7

As the liquid container of Application Example 1, the air introducing portion is installed inside the containing portion.

In an aspect where a valve installed at the air introducing hole is installed to protrude outward the liquid container, for example, in the case where a plurality of the liquid containers containing different liquids are disposed in parallel, the protruding portions may have to be disposed with an interval so that the protruding portions do not interfere with each other. For this reason, with respect to the size of the space occupied by the plurality of the liquid containers, the amount of liquid contained by each liquid container may be decreased. However, according to the aforementioned embodiment, it is possible to dispose the plurality of the liquid containers in a narrower interval than that of the related art. As a result, with respect to the size of the space actually occupied by the plurality of the liquid containers, the amount of liquid contained by each liquid container may be further increased.

Application Example 8

A liquid ejecting apparatus having the liquid container of any one of Application Examples 1 to 7.

In addition, it is preferable that the liquid ejecting apparatus includes a first transport unit transporting a medium, a liquid ejecting unit ejecting the liquid supplied from the liquid container to the medium, and a second transport unit relatively transporting the liquid ejecting unit and the medium in the direction intersecting the transport direction.

In the liquid ejecting apparatus according to the aspect, there is a low probability that each component of the liquid ejecting apparatus or the print medium is contaminated due to the leakage of the liquid in the liquid container.

In addition, the present invention may be implemented as various aspects as follows. (1) A liquid container, a liquid supplying apparatus, and a liquid supplying method. (2) An ink container and an ink supplying apparatus. (3) A liquid consuming apparatus and an ink jet printer.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

1 Configuration of Ink Cartridge

Figures 1A, 1B, 1C:
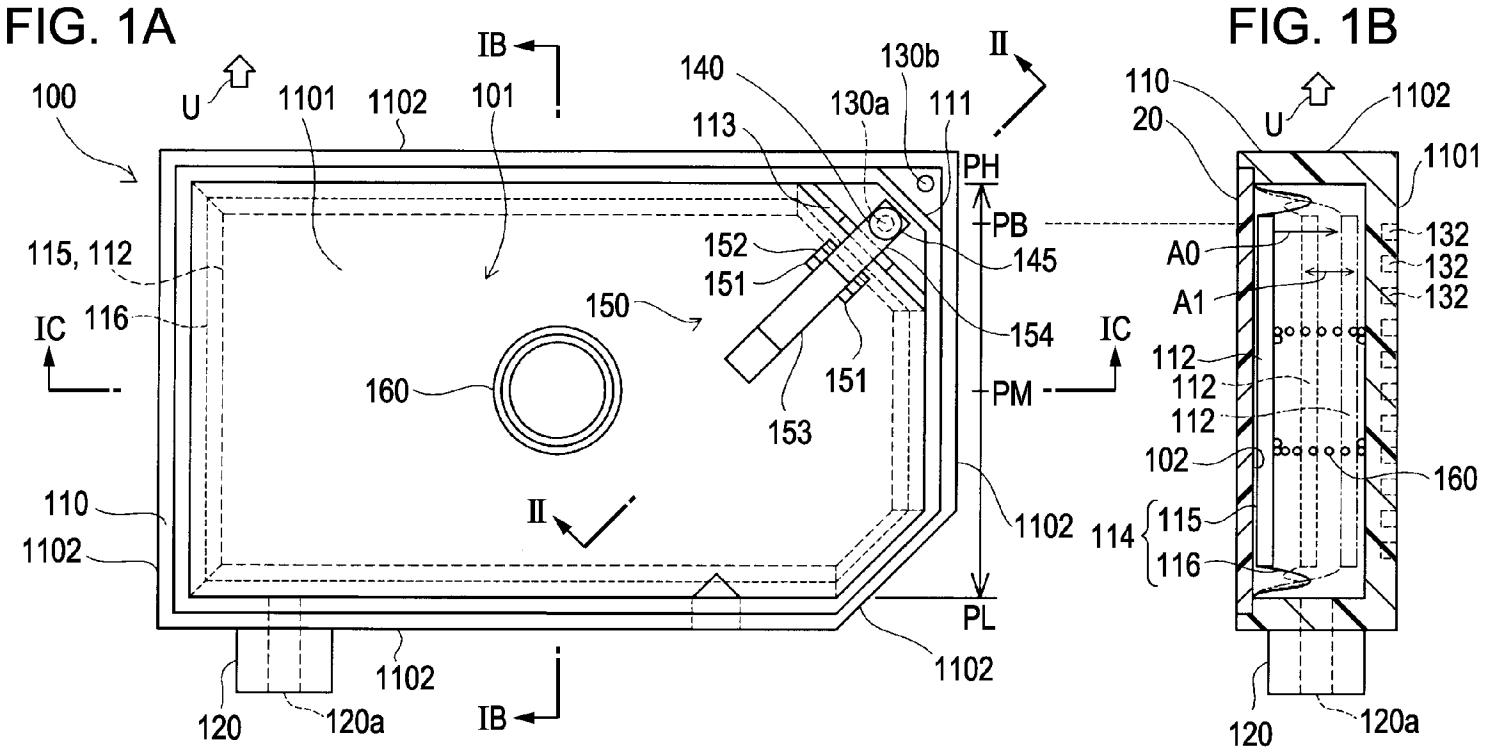
FIGS. 1A to 1C are a plan view and cross-sectional views illustrating an ink cartridge according to a first embodiment.

FIGS. 1A to 1C are a plan view and cross-sectional views illustrating an ink cartridge 100 according to a first embodiment. FIG. 1A is a plan view; FIG. 1B is a cross-sectional view taken along line IB-IB of the upper left view; and FIG. 1C is a cross-sectional view taken along line IC-IC of the upper left view. In addition, for the better understanding of the technology, in each cross-sectional view, some of the components that are to be shown in the inner side of the cross section are omitted.

The ink cartridge 100 is an ink cartridge for a printer capable of printing, for example, up to an A3 sheet for home or office use. The ink cartridge 100 includes a container main body 110 having a shape of a bathtub and a cap member 20 assembled with the container main body 110. The container main body 110 has a bottom portion 1101 and a side wall 1102 and includes a substantially rectangular parallelepiped gap surrounded by the above components, more specifically, a gap having a hexagonal cylinder shape. The cap member 20 is a plate-shaped member constituting an outer shell of the substantially rectangular parallelepiped ink cartridge 100, which is assembled with the container main body 110 to seal the gap. The container main body 110 and the cap member 20 are made of, for example, a synthetic resin such as polypropylene (PP) or polyethylene (PE). In addition, in the plan view of FIG. 1A, for the better understanding of the technology, the cap member 20 and the some other members are illustrated in the state that the members are detached from the ink cartridge 100.

The substantially rectangular parallelepiped gap of the container main body 110 is sealed with a flexible film 114. The film 114 has a planar portion 115 which has a planar shape in the state that no external force is exerted and a curved portion 116 which is disposed around the planar portion 115 and which has a folded shape in the state that no external force is exerted. As indicated by a broken line of FIG. 1A, the outer shape of the planar portion 115 is a substantially hexagonal shape of which the two corners of the rectangle are cut by straight lines. As illustrated in FIGS. 1B and 1C, the outer circumference of the curved portion 116 is welded to the upper end portion of the side wall 1102 of the container main body 110. For this reason, once the film 114 is lifted down from the upper end of the side wall 1102 of the container main body 110 to the bottom portion 1101, the film 114 is reverted in the direction to be separated from the bottom portion 1101 and reaches the central planar portion 115. Ink is contained in a space partitioned by the film 114 and the container main body 110. On the other hand, air is contained in a space 102 between the film 114 and the cap member 20. The structure constructed with the film 114 and the container main body 110 to contain the ink is referred to an "ink containing portion 101". The capacity of the ink containing portion 101 is changed according to the displacement of the planar portion 115 by extending or folding the curved portion 116 of the film 114.

A coil spring 160 is disposed at a substantially central portion of the bottom portion 1101 of the container main body 110. The other end portion of the coil spring 160 supports a pressure receiving plate 112. The pressure receiving plate 112 has the same shape as that of the planar portion 115 of the film 114. In other words, the shape is substantially hexagonal. The pressure receiving plate 112 is pressed toward the planar portion 115 and the cap member 20 by the coil spring 160 at the position overlapping with the planar portion 115 of the film 114. In other words, the coil spring 160 biases the pressure receiving plate 112 in such a direction that the capacity of the ink containing portion 101 is increased.

If the ink in the ink containing portion 101 is consumed so that the volume occupied by the ink is reduced, the negative pressure is generated, and the pressure receiving plate 112 and the planar portion 115 of the film 114 are attracted toward the bottom portion 1101 (refer to arrow A0 of FIGS. 1B and 1C). The positions of the pressure receiving plate 112 after the consumption of ink are indicated by a broken line and a dashed dotted line in FIGS. 1B and 1C. As illustrated in the figure, whereas the film 114 is deformed according to the change in the internal pressure of the ink containing portion 101, the pressure receiving plate 112 is not actually deformed even when the internal pressure of the ink containing portion 101 is changed. However, the pressure receiving plate 112 is displaced according to the deformation of the film 114.

An ink supplying portion 120 including a supply hole 120*a* for supplying the ink to the ink jet printer as a liquid consuming apparatus is installed at a side wall 1102 of the container main body 110. In addition, in the bottom portion 1101 of the container main body 110, an atmosphere opening hole 130*a* for introducing external air into the ink containing portion 101 is installed in the vicinity of the corner portion at the position of the side opposite to the supply hole 120*a* interposing the coil spring 160. The atmosphere opening hole 130*a* is disposed at the position where the atmosphere opening hole 130*a* is not overlapped with the pressure receiving plate 112 in the case where the pressure receiving plate 112 is projected in the extension direction of the coil spring 160, that is, in the direction A0 where the pressure receiving plate 112 is displaced (refer to FIG. 1A).

If the ink cartridge 100 is to be used, the ink cartridge 100 is installed in the posture where the ink supplying portion 120 is located at the lowest position and in the posture where two surfaces of the substantially rectangular parallelepiped ink cartridge 100 are substantially parallel to each other. At this time, the atmosphere opening hole 130*a* is located at the position PB which is higher than the middle position PM between the position PL of the lowest portion and the position PH of the uppermost portion of the gap in the ink containing portion 101. In the embodiment, the position PB is located within 10% from the position PH among the positions between the position PL and the position PH. In the posture, most portions of the pressure receiving plate 112 are located at the position lower than the atmosphere opening hole 130*a* (refer to FIGS. 1A and 1B).

In the bottom portion 1101 of the container main body 110, a wall portion 113 is installed in the vicinity of the corner portion at the position of the side opposite to the supply hole 120*a* interposing the coil spring 160. The atmosphere opening hole 130*a* is installed at the side opposite to the coil spring 160 interposing the wall portion 113. In the bottom portion of the container main body 110, at the position facing the atmosphere opening hole 130*a* with the wall portion 113 interposed therebetween, a transmission arm 150 is installed.

Figure 2:
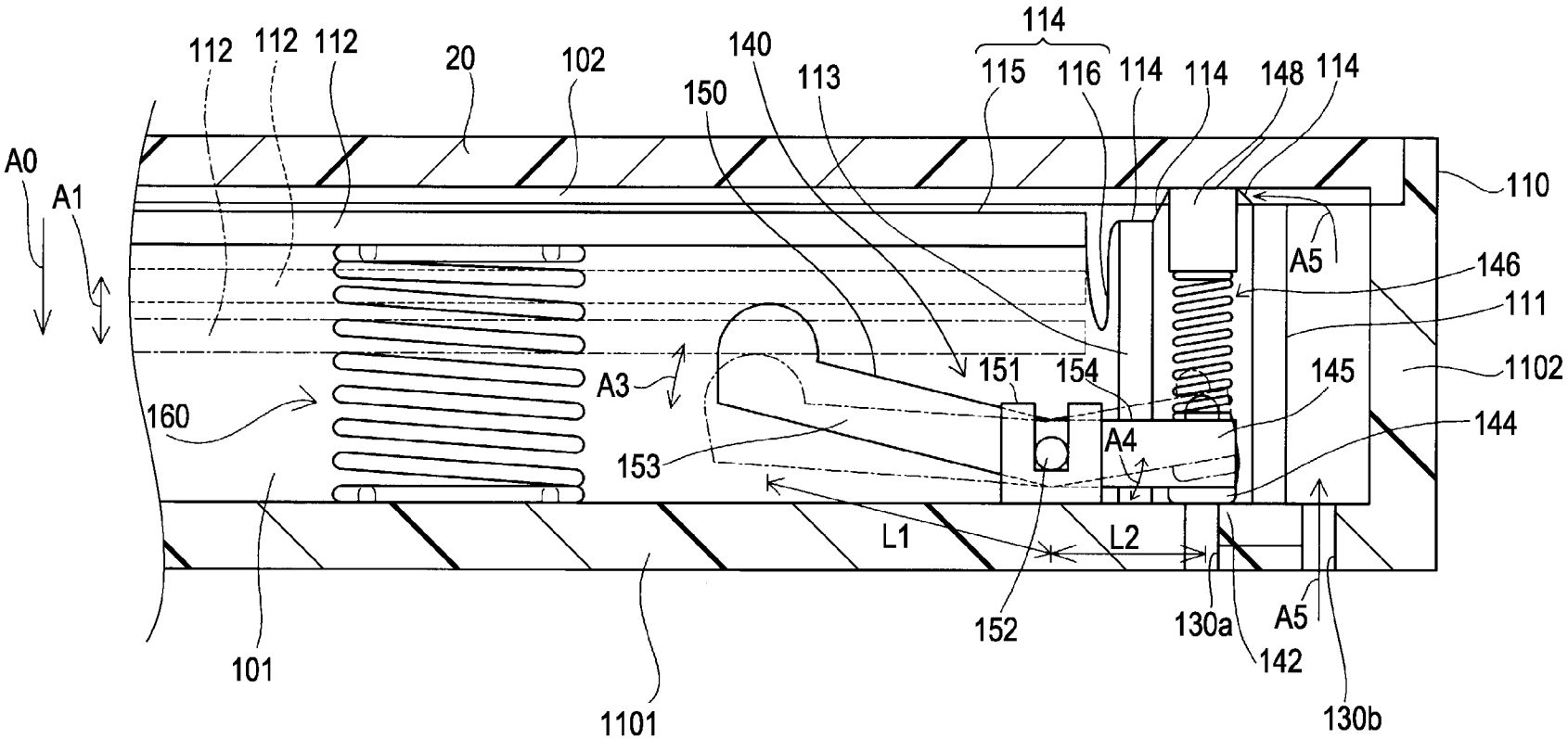
FIG. 2 is a cross-sectional view illustrating an ink cartridge in the vicinity of a transmission arm.

FIG. 2 is a cross-sectional view illustrating the ink cartridge 100 in the vicinity of the transmission arm 150. FIG. 2 is the cross sectional view taken along line II-II of FIG. 1A. The transmission arm 150 includes arm portions 153 and 154 which form an obtuse angle about a supporting point 152. A slit is disposed so as to be lower than the other portions at a substantially central portion of the wall portion 113. The arm portion 154 of the transmission arm 150 reaches an upper portion of the atmosphere opening hole 130*a* over the slit. On the other hand, in the case where the pressure receiving plate 112 is projected in the displacement direction of the pressure receiving plate 112, the arm portion 153 of the transmission arm 150 reaches the position where the front end thereof is overlapped with the pressure receiving plate 112 (refer to FIG. 1A). Two sides of the transmission arm 150 are supported by a pair of supporting portions 151 at the supporting point 152, so that the transmission arm 150 may rotate about the supporting point 152 within a predetermined range (refer to arrows A3 and A4 in FIG. 2). The supporting point 152 and the arm portions 153 and 154 of the transmission arm 150 are made of a synthetic resin such as polypropylene (PP) or polyethylene (PE).

The front end portion 145 of the arm portion 154 of the transmission arm 150 is pressed toward the side of the atmosphere opening hole 130*a* of the bottom portion 1101, that is, toward the outer side of the container main body 110 by a coil spring 146. The other end of the coil spring 146 is supported by the cap member 20 through a spring retainer 148. A ring-shaped sealing member 144 is provided to the side facing the atmosphere opening hole 130*a* in the front end portion 145 of the arm portion 154. The sealing member 144 is made of, for example, an elastomer. The front end portion 145 of the arm portion 154 is pressed on a portion 142 constituting the outer circumference of the atmosphere opening hole 130*a* of the bottom portion 1101 by the coil spring 146, so the atmosphere opening hole 130*a* is sealed by a ring-shaped sealing member 144. In other words, the atmosphere opening hole 130*a* is sealed.

In such a configuration, when the internal pressure of the ink containing portion 101 is increased, the front end portion 145 of the arm portion 154 of the transmission arm 150 in the ink containing portion 101 is pressed toward an external portion by the pressure. For this reason, the atmosphere opening hole 130*a* is strongly sealed by the sealing member 144 and the portion 142 constituting the outer circumference of the atmosphere opening hole 130*a*. Therefore, even in the case where the internal pressure of the ink containing portion 101 is increased, there is a low probability that the ink is leaked to an external portion.

On the other hand, the front end of the arm portion 153 of the transmission arm 150 contacts with the pressure receiving plate 112 when the pressure receiving plate 112 is lifted down to reach a predetermined position (refer to the pressure receiving plate 112 indicated by a broken line in FIG. 2).

Next, when the pressure receiving plate 112 is further lifted down, the front end of the arm portion 153 is pressed down by the pressure receiving plate 112 (refer to the pressure receiving plate 112 and the arm portion 153 indicated by a dashed dotted line in FIG. 2). Therefore, the arm portion 154 located at the opposite side interposing the supporting point 152 is lifted up, and the sealing member 144 is separated from the portion 142 of the bottom portion 1101, so that the atmosphere opening hole 130*a* is opened.

In the transmission arm 150 according to the embodiment, the movement received from the pressure receiving plate 112 by the arm portion 153 is transformed in to the movement in the reverse direction in the arm portion 154, which is the other portion, through the supporting point 152. For this reason, the atmosphere opening hole 130*a*, the components (the portion 142 of the bottom portion 1101, the sealing member 144, the front end portion 145 of the arm portion 154, the coil spring 146, the spring retainer 148, and the like) for opening and closing the atmosphere opening hole 130*a*, and the pressure receiving plate 112 are not necessarily aligned in a straight line. Therefore, it is possible to freely design the distance (free running section) from the position where the pressure receiving plate 112 starts to be lifted down to the position where the pressure receiving plate 112 contacts with the front end portion of the arm portion 153 without limitation to the height of the ink containing portion 101.

In addition, in the transmission arm 150 according to the embodiment, a length L1 from the supporting point 152 of the transmission arm 150 to the front end of the arm portion 153 (the portion contacting with the pressure receiving plate 112) is longer than a length L2 from the supporting point 152 to the front end portion 145 of the arm portion 154 (the portion which is biased by the coil spring 146 to be pressed on the atmosphere opening hole 130*a*) (refer to FIG. 2). For this reason, the sealing member 144 may be able to be separated from the outer circumference portion 142 of the atmosphere opening hole 130*a* by the force stronger than the force by which the front end of the arm portion 153 is pressed by the pressure receiving plate 112. Therefore, in comparison with the aspect where L1≦L2, it is possible to design each factor (for example, an elastic coefficient of the coil spring 146) so that the front end of the arm portion 154 is pressed on the outer circumference portion 142 of the atmosphere opening hole 130*a* by the stronger force in a normal state. In other words, it is possible to design the ink cartridge so that the probability that the ink is leaked to an external portion is lowered even in the normal state.

In addition, the portion 142 constituting the outer circumference of the atmosphere opening hole 130*a* in the bottom portion 1101, the sealing member 144, the transmission arm 150, the coil spring 146, and the spring retainer 148 may perform the function of opening and closing the atmosphere opening hole 130*a*. The portion 142 of the bottom portion 1101, the sealing member 144, the transmission arm 150, the coil spring 146, and the spring retainer 148 are collectively referred to as an "air introducing portion 140".

In the above configuration, all the components of the air introducing portion 140 are installed inside the ink cartridge 100. For this reason, the components of the air introducing portion 140 may be able to be assembled with the container main body 110 from the same side. Therefore, at the time of manufacturing the ink cartridge 100, a process of facing the container main body 110 up and down may be omitted, so that it is possible to easily manufacture the ink cartridge 100.

In addition, in the above configuration, all the components of the air introducing portion 140 are installed inside the ink cartridge 100. In addition, in the ink cartridge 100, a surface of an outer side of the cap member 20 and a surface of an outer side of the bottom portion 1101 of the container main body 110 are installed to be substantially flat (refer to FIGS. 1B and 1C). For this reason, in the case where a plurality of the ink cartridges 100 are disposed so as to be aligned, the ink cartridges 100 may not have to be disposed to be separated from each other by an interval. Therefore, in comparison with an aspect where a portion or all of the components corresponding to the air introducing portion 140 is installed outside the ink cartridge 100 or an aspect having a configuration which protrudes from the surface of the outer side of the cap member 20 and the outer side of the bottom portion 1101 of the container main body 110, it is possible to dispose a plurality of the ink cartridges 100 in a small space.

As illustrated in FIG. 1A, in the bottom portion 1101 of the container main body 110, a wall portion 111 is disposed in the further outer side of the atmosphere opening hole 130*a*. The wall portion 111 together with the bottom portion 1101 and a portion of the side wall 1102 of the container main body 110 and the film 114 constitutes the ink containing portion 101. In other words, a portion of the outer circumference of the film 114 is welded to the upper end of the wall portion 111. In addition, the outer side (the side opposite to the side where the atmosphere opening hole 130*a* exists) of the wall portion 111 is not included in the ink containing portion 101.

In the bottom portion 1101 of the container main body 110, a vent hole 130*b* is disposed at a position facing the atmosphere opening hole 130*a* with the wall portion 110 interposed therebetween. The vent hole 130*b* has a configuration for introducing an external atmosphere into a space 102 between the film 114 and the cap member 20 (refer to the arrow A5 of FIG. 2). Due to such a configuration, when the internal pressure of the ink containing portion 101 is decreased, the planar portion 115 of the film 114 and the pressure receiving plate 112 may be able to be displaced in such a direction that the planar portion 115 of the film 114 and the pressure receiving plate 112 is separated from the cap member 20 and close to the bottom portion 1101.

In the portion of the side (the right side of FIG. 1B and the lower side of FIG. 1C) opposite to the ink containing portion 101 in the bottom portion 1101, a serpentine flow passage 132 is installed. The serpentine flow passage 132 is constructed with groove portions, which are disposed in a zigzag manner in the bottom portion 1101, and a sheet covering thereof. The serpentine flow passage 132 communicates with the atmosphere opening hole 130*a* and the vent hole 130*b* in the vicinity of the one end thereof. In addition, the other end of the serpentine flow passage 132 is open to the atmosphere.

Due to the configuration where the atmosphere opening hole 130*a* and the vent hole 130*b* are not directly opened to an external portion but connected through the serpentine flow passage 132 to the external portion, it is possible to prevent air from being frequently flowed between the ink containing portion 101 or the space 102 between the film 114 and the cap member 20 and the external portion. As a result, while allowing the external air to be introduced into the ink containing portion 101 or the space 102, it is possible to reduce a probability that a viscosity of the ink is increased due to the evaporation of a solvent of the ink in the ink containing portion 101 or the ink is oxidized. For example, even in the case where the air is frequently flowed between the space 102 and the external portion, the solvent (in this case, water) of the ink in the ink containing portion 101 permeates the film 114 to be evaporated, so that the viscosity of the ink may be increased.

2 Operations of Ink Cartridge

In the state where the ink cartridge 100 is unused, the planar portion 115 of the film 114 is pressed toward the cap member 20 through the pressure receiving plate 112 by the coil spring 160. In other words, the space 102 between the film 114 and the cap member 20 is in the minimum state. In this state, the inner portion of the ink containing portion 101 constructed with the film 114 and the container main body 110 is filled with ink (refer to the cross-sectional views of FIGS. 1B and 1C, and FIG. 2). In other words, no air exists in the ink containing portion 101. For this reason, even in the case where the unused ink cartridge 100 is shaken during the transportation or is located in various postures, no air bubbles are mixed into the ink in the ink containing portion 101. As a result, when the ink cartridge 100 is used, no micro-bubbles are not out-flowed through the supply hole 120*a* to the ink jet printer. Therefore, defective ejection caused by, for example, infiltration of air bubbles into piezoelectric devices for ink ejection of an ink jet printer does not occur.

When the ink cartridge 100 is used, the ink cartridge 100 is installed in a posture where the ink supplying portion 120 is located at the lowest position and in a posture where the two surfaces of the ink cartridge 100 having a substantially rectangular parallelepiped shape are substantially horizontal (refer to FIGS. 1A and 1B). In other words, in FIGS. 1A to 1C, the ink cartridge 100 is installed in the posture where the direction indicated by the arrow U is vertically upward.

After that, if the ink is out-flowed from the supply hole 120*a*, the ink in the ink containing portion 101 is reduced. In this state, the atmosphere opening hole 130*a* is sealed by the sealing member 144 at the front end of the arm portion 154. In addition, the coil spring 160 pushes up the pressure receiving plate 112 and the film 114. For this reason, whereas the volume of the ink in the ink containing portion 101 is decreased, the capacity of the ink containing portion 101 is not almost decreased, and the internal pressure of the ink containing portion 101 is decreased.

On the other hand, the space 102 between the film 114 and the cap member 20 communicates with an external portion through the vent hole 130*b* and the serpentine flow passage 132. For this reason, the pressure of the space 102 is maintained in the atmospheric pressure. As a result, the planar portion 115 of the film 114 and the pressure receiving plate 112 are pressed toward the side of the ink containing portion 101, of which the pressure is lower, by the pressure of air in the space 102 to be displaced in the direction indicated by the arrow A0. Next, the planar portion 115 and the pressure receiving plate 112 are stopped at the position where the reaction force of the coil spring 160 increasing according to the increase in the displacement and the force caused by a pressure difference between the space 102 and the ink containing portion 101 decreasing according to the increase in the displacement are balanced.

Until the pressure receiving plate 112 contacts with the arm portion 153, the planar portion 115 and the pressure receiving plate 112 are close to the bottom portion 1101 according to the consumption of the ink (refer to arrows A0 in FIGS. 1 and 2).

If the pressure receiving plate 112 (refer to the pressure receiving plate 112 indicated by the dashed dotted line in FIG. 2) reaches a position below the position contacting with the arm portion 153 due to the consumption of the ink in the ink cartridge 100, as described above, the arm portion 153 may be pressed down by the pressure receiving plate 112, and the arm portion 153 may be lifted up, so that the atmosphere opening hole 130*a* is opened (refer to the arm portions 153 and 154 indicated by the dashed dotted line in FIG. 2). Accordingly, external air is introduced from the atmosphere opening hole 130*a* into the ink containing portion 101. Next, when the inner portion of the ink containing portion 101 reaches the atmospheric pressure, the pressure difference between the space 102 and the ink containing portion 101 is zero. Therefore, the pressure receiving plate 112 and the planar portion 115 of the film 114 may be able to be pushed upwards by the force of the coil spring 160. As a result, the arm portion 153 is no longer restrained. On the other hand, the arm portion 154 is pushed toward the atmosphere opening hole 130*a* of the bottom portion 1101 by the coil spring 146. For this reason, the front end portion (more specifically, the sealing member 144) of the arm portion 154 is pushed back toward the atmosphere opening hole 130*a*, so that the atmosphere opening hole 130*a* is sealed. At this time, the pressure receiving plate 112 is pushed back to the position indicated by the broken line in FIG. 2 or a position slightly higher than that position.

In addition, the air introduced into the ink containing portion 101 is collected in the upper portion inside the ink containing portion 101 (refer to arrow U of FIGS. 1A and 1B). On the other hand, the atmosphere opening hole 130*a* is disposed at the upper position PB in the ink containing portion 101. For this reason, in the early step after air starts to be introduced into the ink containing portion 101, the atmosphere opening hole 130*a* is located above the surface level of the ink. Therefore, in comparison with the aspect where the atmosphere opening hole 130*a* is located below the middle position PM, there is a low probability that the ink is leaked from the atmosphere opening hole 130*a*.

In addition, once the ink cartridge 100 starts to be used, there is a low probability that the ink cartridge 100 is separated from the ink jet printer to be delivered for a long time or rotated in various postures. For this reason, as a result of the aforementioned operation, the probability that the air introduced into the ink containing portion 101 becomes air bubbles and is out-flowed to the ink jet printer is low in comparison with the aspect where the air exists in the ink containing portion 101 in the state before starting the use of the ink cartridge.

After that, if the pressure receiving plate 112 reaches a position below the position contacting with the arm portion 153 due to the further consumption of the ink, the aforementioned operations are repeated. As a result, as indicated by the arrows A1 in FIGS. 1 and 2, the planar portion 115 of the film 114 and the pressure receiving plate 112 repetitively move upward and downward. At this time, the closer the pressure receiving plate 112 is located to the bottom portion 1101, the more the internal pressure of the ink containing portion 101 is decreased. The further away the pressure receiving plate 112 is located from the bottom portion 1101, the more the internal pressure of the ink containing portion 101 is increased. However, the internal pressure of the ink containing portion 101 is maintained within a range between the atmospheric pressure and a predetermined pressure less than the atmospheric pressure. As a result, the ink may be supplied stably from the supply hole 120*a* to the ink jet printer. In addition, the direction (arrows A0 and A1) where the pressure receiving plate 112 is to be displaced is the horizontal direction when the ink cartridge 100 is in the usage posture (refer to FIG. 1B).

In the above configuration, since the pressure receiving plate 112 is provided, the force of the coil spring 160 may be able to be uniformly transmitted through the pressure receiving plate 112 to the film 114. In addition, a force caused by a pressure difference between the space 102 and the ink containing portion 101 may be able to be stably transmitted through the pressure receiving plate 112 to the arm portion 153 of the transmission arm 150.

In the aforementioned aspect, when the atmosphere opening hole 130*a* is to be opened and closed, it is preferable that the displacement of the pressure receiving plate 112 is received at the position as close as to the central portion of the pressure receiving plate 112 as possible so as to close and open the atmosphere opening hole 130*a*. This is because there is a probability that the pressure receiving plate 112 may be displaced in the state of being slanted with respect to the bottom portion 1101 as well as in the state of being maintained in the posture where the pressure receiving plate 112 is always parallel to the bottom portion 1101. On the other hand, as described above, it is preferable that the atmosphere opening hole 130*a* is located at the upper position PB inside the ink containing portion 101 (refer to FIGS. 1A and 1B). For this reason, it is preferable that the atmosphere opening hole 130*a* is installed in the vicinity of the corner of the bottom portion 1101.

In the embodiment, the movement received from the pressure receiving plate 112 by the arm portion 153 is transmitted to the movement in the reverse direction in the arm portion 154, which is the other portion, by the transmission arm 150. Due to such a configuration, in the embodiment, it is possible to simultaneously stably receive the force caused by the pressure difference at the position close to the central portion of the pressure receiving plate 112 and to close and open the atmosphere opening hole 130*a* installed at the corner of the bottom portion 1101.

In addition, in the case where the pressure receiving plate 112 and the planar portion 115 has a shape having concave portions, for example, such as a star shape, the curved portion 116 has a three dimensional shape having ridges and valleys in the radial manner in the connection portion of the pressure receiving plate 112 and the planar portion 115. In such an aspect, there is a case where the curved portion 116 is not easy to be folded when the pressure receiving plate 112 and the planar portion 115 are displaced according to the change in the internal pressure of the containing portion, and thus, the curved portion 116 is folded or extended from the folded state (refer to the arrow A1 in FIGS. 1 and 2). In addition, there is a case where the ridge portion or the valley portion is rapidly folded after the internal pressure of the ink containing portion 101 is somewhat decreased. In addition, there is also a probability that the portions, which are folded and overlapped with each other once, are not extended smoothly due to abrasion. In addition, there is a probability that, after the internal pressure of the ink containing portion 101 is somewhat increased, the folded and overlapped portions are rapidly extended. In such a case, the internal pressure of the ink containing portion 101 is also rapidly changed (increased and decreased). For this reason, the ink is not stably supplied from the supply hole 120*a* to the ink jet printer.

However, in the above configuration, the outer shapes of the pressure receiving plate 112 and the planar portion 115 is a substantially hexagonal shape, which is a shape protruding convexly outwards without a concave portion. For this reason, the curved portion 116 connected to surround the planar portion 115 does not have a valley-shaped portion. Therefore, the curved portion 116 may be stably folded or extended. In other words, when the curved portion 116 is deformed according to the displacement of the pressure receiving plate 112 and the planar portion 115, the curved portion 116 is not rapidly deformed. Therefore, the internal pressure of the ink containing portion 101 is not rapidly changed.

In addition, in the embodiment, the ink containing portion 101 (container main body 110 and film 114) corresponds to the "containing portion" disclosed in the SUMMARY. The supply hole 120*a* corresponds to the "liquid out-flowing hole". The atmosphere opening hole 130*a* corresponds to the "air introducing hole". The pressure receiving plate 112 and the film 114 correspond to the "deforming portion". The air introducing portion 140 (a portion 142 of the bottom portion 1101, the sealing member 144, the transmission arm 150, the coil spring 146, and the spring retainer 148) corresponds to the "air introducing portion". The portion 142 constituting the outer circumference of the atmosphere opening hole 130*a* in the bottom portion 1101 of the container main body 110 corresponds to the "first sealing portion". The front end portion 145 of the arm portion 154 of the transmission arm 150 and the sealing member 144 correspond to the "second sealing portion". The coil spring 146 corresponds to the "biasing portion".

In the embodiment, the pressure receiving plate 112 corresponds to the "rigid portion" disclosed in the SUMMARY. The film 114 corresponds to the "flexible portion". The transmission arm 150 corresponds to the "transmitting portion". The curved portion 116 corresponds to the "curved portion".

B. Second Embodiment

Figure 3:
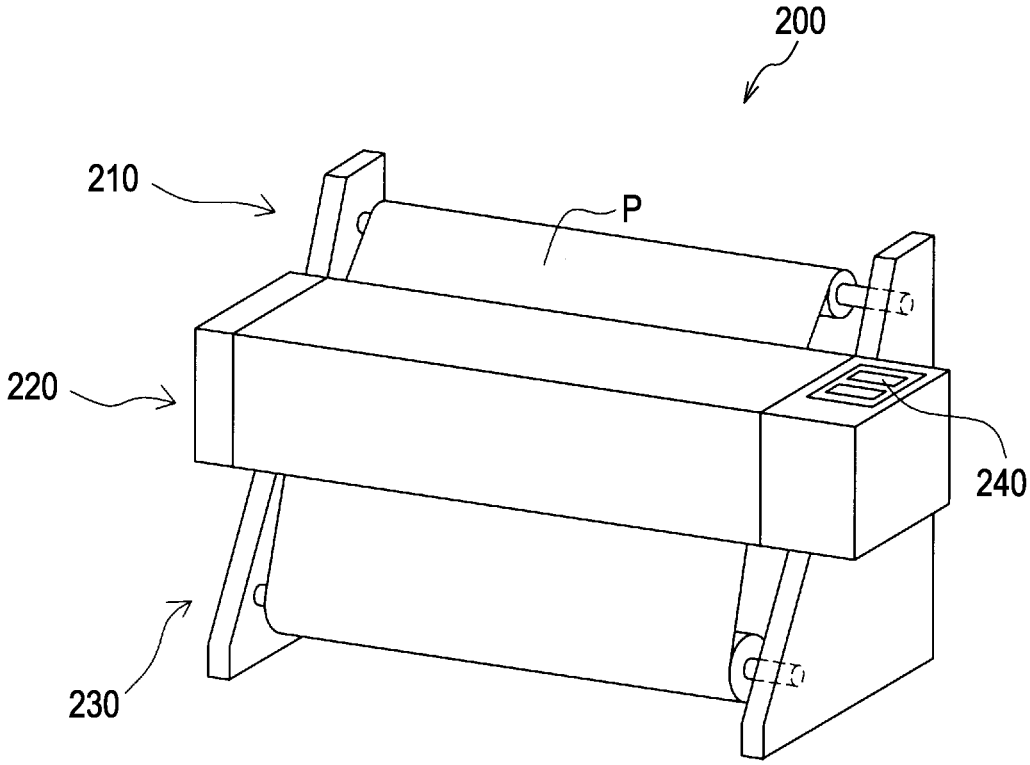
FIG. 3 is a schematic perspective view illustrating a configuration of a printer according to a second embodiment.

FIG. 3 is a schematic perspective view illustrating a configuration of a printer 200 according to a second embodiment. The printer 200 is a printer dealing with a relatively large sized print sheet P, for example, JIS standard column A #0 paper or column B #0 paper or a roll sheet. The print sheet P is fed from a sheet feed unit 210 to a printing unit 220. The printing unit 220 performs printing by ejecting the ink on the supplied print sheet P. The print sheet P which is printed by the printing unit 220 is discharged to a sheet discharge unit 230. On the upper surface of the printing unit 220, keys through which a print mode or the like may be input and an input/output unit 240 including a display unit are installed.

Figure 4:
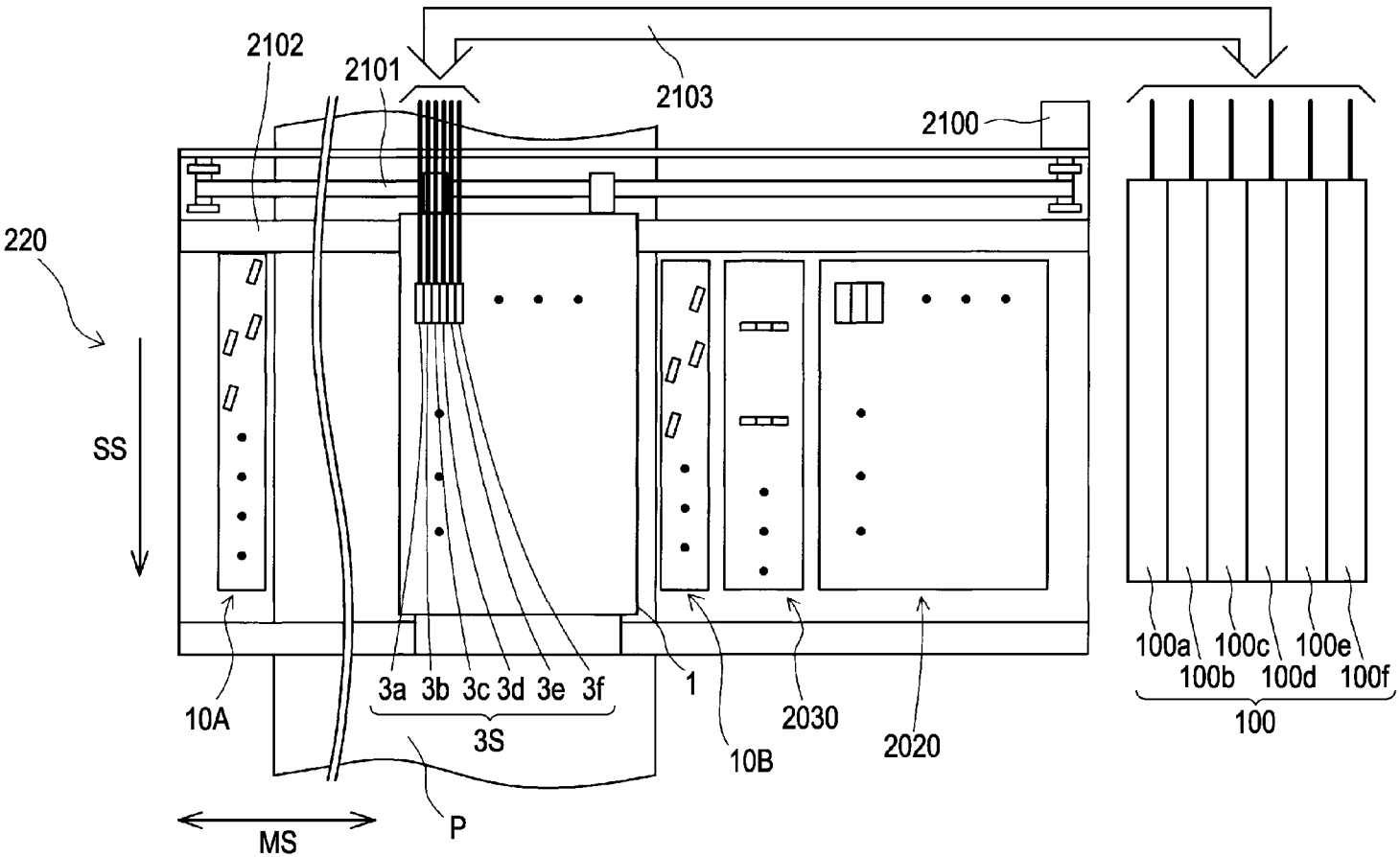
FIG. 4 is a view illustrating a configuration of a printing unit.

FIG. 4 is a view for explaining a configuration of the printing unit 220. The printing unit 220 includes a carriage 1 in which a plurality of print heads are installed. In the carriage 1, a set 3S of sub tanks which temporarily store ink used by the print head is mounted. The carriage 1 is connected to a driving belt 2101 driven by a carriage motor 2100 and guided to a main scan guide member 2102, so that the carriage 1 may be able to be moved in the main scan direction MS. In the case of performing printing, while the carriage 1 is being moved in the main scan direction, the printing is performed by ejecting the ink from nozzles to the print sheet P. On the other hand, the print sheet P is transported in the sub scan direction SS.

At the two ends of the print sheet P in the moving range of the carriage 1 in the main scan direction, a first checking portion 10A and a second checking portion 10B which performs ejection checking of the nozzles are installed. At the side of the second checking portion 10B, a wiper portion 2030 which performs nozzle wiping, a cap portion 2020 which seals the nozzle group and performs cleaning thereof, and a plurality of main tanks 100*a* to 100*f* for supplying the ink to the sub tank set 3S are installed. Each of the main tanks 100*a* to 100*f* has the configuration of the ink cartridge 100 described in the first embodiment. In addition, the main tanks 100*a* to 100*f* are collectively referred to as a "main tank 100".

The sub tank set 3S and the main tank 100 are connected to each other by the ink supplying channel 2103. In the embodiment, there are sub tanks 3*a* to 3*f* for six types of ink, that is, black K, cyan C, light cyan LC, magenta M, light magenta LM, and yellow Y. The six sub tanks 3*a* to 3*f* are connected to the corresponding six main tanks 100*a* to 100*f*, respectively. However, available ink is not limited to the six types of ink, but four types of ink (for example, black K, cyan C, magenta M, and yellow Y), seven types of ink (for example, black K, light black LK, cyan C, light cyan LC, magenta M, light magenta LM, and yellow Y) among others may be also used.

The main tanks 100*a* to 100*f* are disposed in parallel. As described in the first embodiment, in each of the main tanks 100*a* to 100*f*, the surface of the outer side of the cap member 20 and the surface of the outer side of the bottom portion 1101 of the container main body 110 are installed to be substantially flat (refer to FIGS. 1B and 1C). For this reason, the main tanks 100*a* to 100*f* may be disposed so as to be close to each other. Therefore, in comparison with the aspect having a configuration which protrudes from the surface of the outer side of the cap member 20 and the outer side of the bottom portion 1101 of the container main body 110, it is possible to dispose the main tanks 100*a* to 100*f* in a small space.

In the embodiment, the printer 200 corresponds to the "liquid ejecting apparatus" disclosed in the SUMMARY. The sheet feed unit 210 corresponds to the "first transport unit". The print head of the printing unit 220 corresponds to the "liquid ejecting unit". The carriage 1, the carriage motor 2100, the driving belt 2101, and the main scan guide member 2102 correspond to the "second transport unit".

C. Modified Examples

C1. Modified Example 1

In the aforementioned embodiments, the displacement of the pressure receiving plate 112 may be able to be transmitted to the front end portion 145 and the sealing member 144 by the transmission arm 150 (arm portions 153 and 154) which may be able to rotate about the supporting point 152. However, the configuration transmitting the displacement of the pressure receiving plate 112 to the front end portion 145 and the sealing member 144 may be implemented in different aspects. For example, there may be used an aspect where the displacement of the pressure receiving plate 112 is transmitted by a configuration, of which the entire portion is displaced, such as a parallel displacement instead of the rotation. In addition, there may also be used an aspect where the displacement of the pressure receiving plate 112 may be transmitted through a link. In the former aspect, the displacement of the pressure receiving plate 112 may be transmitted to the front end portion 145 as a displacement in the same direction as the displacement direction or as a displacement in a different direction where the angle with the displacement direction is 90 degrees or less. In the latter aspect, the displacement direction of the pressure receiving plate 112 may be changed in an arbitrary direction, and the displacement of the pressure receiving plate 112 may be transmitted to the portion 145.

In other words, in an aspect, the transmitting portion may transmit the deformation of the deforming portion to the second sealing portion in the same direction as the displacement direction. In addition, in another aspect, the transmitting portion may change the deformation of the deforming portion in the different direction to be transmitted to the second sealing portion. In addition, the displacement or the deformation of the pressure receiving plate 112 or the film 114 as the deforming portion may be transmitted to the portion 145 as the second sealing portion as the displacement or the force.

C2. Modified Example 2

In the aforementioned embodiments, the length L1 from the supporting point 152 of the transmission arm 150 to the front end of the arm portion 153 is longer than the length L2 from the supporting point 152 to the front end portion 145 of the arm portion 154. However, the aspect where L1≦L2 may also be used.

C3. Modified Example 3

In the aforementioned embodiments, when the ink cartridge 100 is used, the planar portion 115 of the film 114 and the pressure receiving plate 112 are moved in the horizontal direction (refer to arrows A0 and A1 in FIGS. 1 and 2). However, the configuration displacing according to the change in the internal pressure of the containing portion may be implemented, for example, as an aspect where the displacement is generated in the vertical direction or as an aspect where the displacement is generated in a direction different from the vertical or horizontal direction. However, in an aspect where the configuration displacing according to the internal pressure of the containing portion is moved in the horizontal direction or in the direction angled by 45 degrees or less with the horizontal direction in the vertical plane, the atmosphere opening hole 130*a* or the air introducing portion 140 is easily provided at a position which does not interfere with the configuration where the displacement is generated according to the change in the internal pressure of the containing portion and the position above the ink containing portion 101.

C4. Modified Example 4

In the aforementioned embodiments, the atmosphere opening hole 130*a* is provided at the position PB which is within 10% from the uppermost portion PH among the positions between the lowest portion PL and the uppermost portion PH of the gap in the ink containing portion 101. However, the atmosphere opening hole 130*a* may be provided at a different position. However, the atmosphere opening hole 130*a* is preferably provided at a position which is within 50% from the uppermost portion PH among the positions between the lowest portion PL and the uppermost portion PH of the gap in the ink containing portion 101, and more preferably provided at a position which is within 25%.

C5. Modified Example 5

In the aforementioned embodiments, the pressure receiving plate 112 and the planar portion 115 of the film 114 have a substantially hexagonal outer shape. However, the pressure receiving plate 112 and the planar portion 115 are not limited to the substantially hexagonal shape, but various shapes may be used. However, a shape protruding convexly outwards is preferred other than a shape having a concave portion such as a crescent shape or a star shape. For example, in the case of a polygon, a polygon of which the size of the internal angle of the corner is less than 180 degrees is preferred.

C6. Modified Example 6

In the aforementioned embodiments, all the components (the portion 142 of the bottom portion 1101, the sealing member 144, the transmission arm 150, the coil spring 146, the spring retainer 148, and the like) of the air introducing portion 140 are installed at the side (the side of the gap of the ink containing portion 101) more inner than the bottom portion 1101 of the container main body 110 of the ink cartridge 100. However, some components of the air introducing portion 140 may also be installed at the side more outer than the ink containing portion 101 as an outer shell of the ink cartridge 100.

C7. Modified Example 7

In the aforementioned embodiments, the sealing member 144 is constructed with an elastomer, and the portion 142 constituting the outer circumference of the atmosphere opening hole 130*a* as a portion of the container main body 110 is made of a synthetic resin such as polypropylene (PP) or polyethylene (PE). In other words, the portion 142 as the first sealing portion is not more flexible than the other portions of the container main body 110. In addition, the sealing member 144 as a portion of the second sealing portion is more flexible than the other portions of the container main body 110 or the transmission arm 150. However, there may also be used an aspect where the second sealing portion is more flexible or elastic than the other portions of the container main body 110 or the transmission arm 150, and the first sealing portion does not have such flexibility or elasticity. However, it is preferable that at least one of the first and second sealing portions is elastically deformed more easily than the member constituting the outer shell of the liquid container. According to such an aspect, it is possible to more securely seal the air introducing hole by a smaller force.

C8. Modified Example 8

In the aforementioned embodiments, in the state before the ink is consumed, the pressure receiving plate 112 is biased by the coil spring 160. However, there may also be used an aspect where the coil spring 160 biases the pressure receiving plate 112 in the direction against the displacement by the negative pressure even after the capacity of the ink containing portion 101 is somewhat reduced due to the consumption of the ink. In the state before the pressure receiving plate 112 is biased by the coil spring 160, the pressure receiving plate 112 may generate the negative pressure in the ink containing portion 101 by an elastic force of the film against the deformation caused by, for example, the consumption of the ink.

C9. Modified Example 9

In the aforementioned embodiments, the coil spring is used as a spring biasing each portion. However, as a configuration biasing each portion, various types of other aspects such as a plate spring or a resin member having flexibility may be used.

C10. Modified Example 10

In the aforementioned embodiments, the ink cartridge 100 is an ink cartridge for a printer for home or office use. However, the ink cartridge as a liquid container according to the invention may also be used as an ink cartridge of a large sized printer for office use.

In addition, in the second embodiment, an ink jet printer (so-called off-carriage type printer, refer to FIGS. 3 and 4) where the ink cartridge 100 as a main tank is provided separately from the carriage 1 where the print head and the sub tank are installed is exemplified. However, the liquid container according to the invention may be adapted to an ink jet printer (so-called on-carriage type printer) where a cartridge mounting portion which is integrated with the print head is reciprocally moved in the paper width direction of the print medium.

C11. Modified Example 11

In the aforementioned embodiments and modified examples, the ink jet printer and the ink cartridge are described. However, the invention may be used for a liquid ejecting apparatus which sprays or ejects a liquid other than ink. In addition, the invention may be used for a liquid container which contains such a liquid. The liquid container according to the invention may be adapted to various types of liquid consuming apparatuses having a liquid ejecting head or the like, which ejects a micro amount of liquid droplets. In addition, the "liquid droplet" denotes a state of a liquid ejected from the liquid ejecting apparatus including the liquid droplet leaving a tail in a granular shape, a tear-like shape, and a thread-like shape. In addition, the "liquid" referred hereinbefore may be any material which may be able to be ejected by the liquid ejecting apparatus. For example, a material in a liquid state may be used. In addition, a liquid state having a high or low viscosity, a sol solution, a gel water, other fluid states such as inorganic solvents, organic solvents, solutions, liquid resins, and liquid metals (metal solution) may be included. In addition, a material where particles of a functional material made of a solid material such as pigments or metal particles are dissolved into a solvent, dispersed, or mixed as well as a liquid as a one-state material may be included. In addition, as a representative example of the liquid, there may be ink, a liquid crystal, or the like described in the aforementioned embodiments. Herein, the ink may include general water-based ink and oil-based ink and various types of liquid compositions such as gel ink and hot-melt ink. As an detailed example of the liquid ejecting apparatus, there may be, for example, a liquid crystal display, an EL(electro luminance) display, a surface emission display, a liquid ejecting apparatus which ejects a liquid including a state where a material such as an electrode material or a color material used for manufacturing a color filter or the like is dispersed or dissolved, a liquid ejecting apparatus which ejects a bio organic material used for manufacturing a bio chip, or a liquid ejecting apparatus which ejects a liquid which becomes a sample and which is used as a micro pipette. In addition, a liquid ejecting apparatus which ejects a lubricant with a pinpoint to a precision machine such as a watch or a camera, a liquid ejecting apparatus which ejects a transparent liquid resin such as a UV curing resin on a substrate so as to form a micro semispherical lens (optical lens) or the like used for an optical communication device or the like, and a liquid ejecting apparatus which ejects an etchant solution such as an acidic solution or an alkali solution used for etching a substrate or the like may be employed. In addition, the invention may be adapted to any one of the aforementioned ejecting apparatuses or the liquid container.

What is claimed is:

1. A liquid container adapted to supply a liquid to a liquid ejecting apparatus, comprising:

a main body having a bottom portion and a side wall;

a cap member assembled with the main body;

an inner space defined by the main body and the cap member;

a flexible film partitioning the inner space into a liquid containing portion defined by the main body and the film and having a variable volume, and an air containing portion between the film and the cap member;

a vent hole adapted to introduce an external atmosphere into the air containing portion;

an air introducing hole for introducing external air into the liquid containing portion;

a spring provided between the bottom portion and the film;

a pressure receiving plate provided between the spring and the film, the pressure receiving plate being biased by the spring in a direction that the volume of the liquid containing portion is increased;

a transmission arm having a contact portion adapted to contact the pressure receiving plate and a sealing portion adapted to open and close the air introducing hole; and a biasing portion pressing the sealing portion toward the air introducing hole, wherein the pressure receiving plate remains spaced away from the bottom portion and the air introducing hole is closed by the sealing portion, in a first state when the liquid containing portion has a first volume, the pressure receiving plate moves closer to the bottom portion with the volume of the liquid containing portion decreasing from the first volume to a second volume according to the consumption of the liquid, the pressure receiving plate moves close enough to the bottom portion to make contact with the contact portion of the transmission arm, the sealing portion of the transmission arm moving away from the air introducing hole, in a second state when the liquid containing portion has the second volume, the external air is introduced into the liquid containing portion via the air introducing hole when the air introducing hole is opened by the sealing portion moving away from the air introducing hole, the pressure receiving plate being pushed upwards by the spring so that the pressure receiving plate moves away from the bottom portion such that the air introducing hole is subsequently closed by the sealing potion.

2. The liquid container according to claim 1, wherein the sealing portion is disposed at such a position that the sealing portion is not overlapped with the pressure receiving plate when the pressure receiving plate is projected in a displacement direction of the pressure receiving plate.

3. The liquid container according to claim 1, wherein the transmission arm has a supporting point, and a distance from the supporting point to a portion that contacts pressure receiving plate is longer than a distance from the supporting point to the sealing portion.

4. The liquid container according to claim 1, wherein the pressure receiving plate is displaced in a horizontal direction, and the air introducing hole is located at a position higher than at least a portion of the pressure receiving plate.

5. The liquid container according to claim 1, wherein the air introducing hole is located at a position above a half position of the containing portion.

6. The liquid container according to claim 1, wherein the flexible film includes a rigid portion supported by the pressure receiving plate and a curved portion which is connected to the rigid portion in an outer circumference of the rigid portion, the curved portion is deformable with varying the volume of the liquid containing portion.

7. The liquid container according to claim 1, further comprising a serpentine flow passage connecting the vent hole and the air introducing hole to an external portion.

* * * * *